US007735580B2

(12) United States Patent
Kraus et al.

(10) Patent No.: US 7,735,580 B2
(45) Date of Patent: Jun. 15, 2010

(54) DEVICE FOR CHARGING A DRILLING DEVICE AND DRILLING APPARATUS

(75) Inventors: Michael Kraus, Olpe (DE); Carl Hagemeyer, Olpe (DE); Albert Clemens, Wenden (DE)

(73) Assignee: Klemm Bohrtechnik Zweigniederlassung der Bauer Maschinen GmbH, Drolshagen (DE)

( * ) Notice: Subject to any disclaimer, the term of this patent is extended or adjusted under 35 U.S.C. 154(b) by 204 days.

(21) Appl. No.: 11/681,968

(22) Filed: Mar. 5, 2007

(65) Prior Publication Data

US 2007/0209838 A1 Sep. 13, 2007

(30) Foreign Application Priority Data

Mar. 7, 2006 (EP) ..... 06004639

(51) Int. Cl.
*E21B 19/20* (2006.01)
*E21B 19/14* (2006.01)

(52) U.S. Cl. ..... 175/52; 175/85; 414/22.63

(58) Field of Classification Search ..... 175/52, 175/57, 85; 414/22.65, 22.66, 22.68, 22.69, 414/22.63
See application file for complete search history.

(56) References Cited

U.S. PATENT DOCUMENTS 3,734,209 A * 5/1973 Haisch et al. ..... 175/57
4,013,178 A * 3/1977 Brown ..... 414/22.63
5,215,153 A 6/1993 Younes
6,164,391 A * 12/2000 Wurm ..... 175/52
6,702,043 B2 * 3/2004 Koch et al. ..... 175/52

FOREIGN PATENT DOCUMENTS

| | | | |
|---|---|---|---|
| DE | 198 10 707 | A1 | 9/1999 |
| DE | 299 03 909 | U1 | 10/1999 |
| DE | 198 30 447 | A1 | 1/2000 |
| DE | 10108696 | A1 | 2/2001 |
| DE | 101 08 696 | B4 | 9/2002 |
| DE | 10341437 | A1 | 7/2005 |
| EP | 0 379 187 | A1 | 7/1990 |
| EP | 0 565 502 | B2 | 10/1993 |
| EP | 0860582 | A1 | 2/1997 |
| EP | 0 860 580 | B1 | 8/1998 |
| EP | 0 860 582 | B1 | 8/1998 |
| JP | 08296389 | | 12/1996 |

OTHER PUBLICATIONS

Weber & Heim, Letter & European Search Report, Jan. 30, 2008.

* cited by examiner

*Primary Examiner*—Jennifer H Gay
*Assistant Examiner*—Brad Harcourt
(74) *Attorney, Agent, or Firm*—Hoffman Warnick LLC

(57) ABSTRACT

The invention relates to a device for charging a drilling device of an earth or rock drilling apparatus with a double rod. The device has a rotatable revolver magazine, which is designed with double receiving spaces for receiving two tube parts that are inserted into one another.

13 Claims, 11 Drawing Sheets

DEVICE FOR CHARGING A DRILLING DEVICE AND DRILLING APPARATUS

The invention relates to a device for charging a drilling device, in particular an earth or rock drilling apparatus, with a double rod, comprising a rod magazine that has several receiving spaces for inner tubes and outer tubes of the double rod and a manipulator for gripping and moving the tubes into and out of the rod magazine.

A device for charging a drilling apparatus with a drill rod is known for instance from DE 101 08 696 B4. The known device has a rod magazine which is fixed with regard to a mounting and comprises several tube depositories, in which the outer and inner tubes of the double rod can be received by being inserted into one another. The tubes are arranged in a partial circle about a longitudinal axis. To transport the drill tubes between the magazine and a drill drive a gripper is provided that can be rotated about the longitudinal axis of the magazine. However, in such a device single depositing positions may be concealed and can hardly be seen by the operator which may be unfavourable in manual operation.

Another device having a fixed, partially cylindrical magazine as well as a gripper that can be pivoted about the cylindrical axis is known from EP 0 379 187 A1.

DE 198 10 707 A1 discloses a drilling machine having a drum magazine, at the circumference of which inner tubes and outer tubes of a double rod are each arranged in groups next to each other. In accordance with DE 198 10 707 A1 a clamping roller arrangement is provided, by means of which an inner tube is moved axially out of the drum magazine. Afterwards the inner tube is lowered axially again whilst being inserted into a neighbouring outer tube. The combination consisting of outer tube and inner tube is then pivoted into the drilling axis where it is seized by a clamping claw.

Another pivotable magazine can be taken from U.S. Pat. No. 5,215,153.

From EP 0 860 582 B1 a further device for double head drilling and simultaneous drilling is known. The known device has a drum magazine, in which the inner tubes and the outer tubes are arranged successively in the radial direction in separate locations. To this end a drawer and setter is provided, with which the inner rod is first taken out of the magazine in the upper direction, positioned coaxially over the outer tube and then inserted into the latter. Afterwards both tubes are jointly moved into the drilling axis.

Likewise, from EP 0 860 580 B1 a drilling device is also known, in which inner tubes and outer tubes are supported separately. During downward drilling an inner tube is gripped first, transported into the drilling axis and connected to the drill drive. Afterwards, the drill drive is moved back axially and the outer tube is transported into the drilling position. Through a movement of the drill drive the inner tube is then inserted into the outer tube and the outer tube is also connected to the drill drive.

EP 0 565 502 B2 discloses a rock drilling machine having a case magazine, in which tube elements are arranged on top of one another.

Further case magazines are known from DE 198 30 447 A1 and from DE 299 03 909 U1.

U.S. Pat. No. 3,734,209 describes a drilling device, in which double drill rod parts are supported next to each other on a feed slide.

The object of the invention is to provide a device for charging a drilling device of an earth or rock drilling apparatus with a double rod, which ensures a particularly high reliability and operational safety and at the same time maintains a compact and simple construction of the device.

The object is solved in accordance with the invention by a device having the features of claim 1. Preferred embodiments are indicated in the dependent claims.

The device according to the invention is characterized in that the rod magazine is designed as a rotatable revolver magazine comprising double receiving spaces, which each have a retaining element for an outer tube and a further retaining element for an inner tube arranged inside the outer tube.

A fundamental idea of the invention can be considered to reside in the design of a revolver magazine with double receiving spaces, which each allow for a tube pair consisting of an inner tube and an outer tube to be supported in the same place. According to the invention the inner tubes and the outer tubes can be retained in the magazine by a position being inserted into one another. Hence, the tubes can be kept in the magazine precisely in the arrangement in which they are positioned during double tube drilling. As a result, the number of gripping processes required during the charging of the drilling device or during magazine storage is reduced so that a particularly reliable operation and especially a particularly simple control of the manipulator is ensured whilst having a simple constructional design. The operational safety, especially where the handling of the manipulator is concerned, is improved further by the fact that the double receiving spaces are not stationary but provided on a rotatable revolver magazine. This revolver magazine allows the magazine-stored double drill rod parts present in the drilling arrangement to be moved to the same transfer position every time, where they can be properly seen by an operator gripped in a particularly reliable manner by the manipulator and moved into the drilling axis.

A revolver magazine can be understood in particular as a magazine, in which the receiving spaces and/or the received tubes are arranged around the axis of rotation of the magazine, and here it is suitable for the longitudinal axes of the received tubes to extend in parallel to the axis of rotation. In order to achieve a particularly simple drive of the magazine, the axis of rotation preferably extends centrally with respect to the receiving spaces, especially along a central axis of the rod magazine.

By preference, the receiving spaces are arranged on a circle, whose centre suitably lies on the axis of rotation of the rod magazine. The longitudinal axes of the tubes and the receiving spaces can be located on a cylinder jacket, whose longitudinal axis coincides with the axis of rotation. Such an arrangement as a drum magazine proves to be especially compact.

A device with a particularly simple construction is provided in that the rod magazine has a central axle tube, through which the rod magazine is supported on at least one bearing point. By preference, the support by means of the central axle tube is provided at least on the front end of the rod magazine that faces away from the receiving spaces. This kind of support allows for a particularly easy access to the magazine-stored tubes. It is also possible for the rod magazine to be supported at several points on the central axle tube, and in principle the central axle tube can also be discontinuous. According to the invention it is especially advantageous for the rod magazine to be supported in an exchangeable manner in the device. The exchangeable function of the magazine permits a quick and simple change-over of the device to a different rod system.

For this purpose it is of advantage that at least one bearing point of the rod magazine is detachable. By providing detachable bearing points an exchangeable magazine can be created in an especially simple manner. The detachable bearing point can have two or more bearing shells for example, which can be detached from one another and can be closed again. In particular, a bearing shell can be provided in a pivotable manner with respect to another bearing shell. Through this a bearing point can be created that can be folded out for example. It is most favourable for the bearing points to comprise friction or roller bearings.

Furthermore, according to the invention it is advantageous for the rod magazine to be designed of several parts comprising a receiving part, on which the receiving spaces are arranged, and a drive part, on which a rotary magazine drive is arranged, the receiving part being in particular mounted in a detachable manner on the drive part. In doing so a magazine can be created, which can be divided into parts and in which the receiving spaces including the tubes supported therein can be detached from the drive part of the magazine, whereby a particularly good handling is provided. By preference, the receiving part and the drive part are connected via a plug connection that can be released through an axial movement in the direction of the axis of rotation of the magazine and/or the longitudinal axis of the received drill tubes. In particular, a plug connection may be provided on the central axle tube. To achieve a power transmission between the drive part and the plugged-on receiving part it is suitable for the plug connection to be designed in a rotationally fixed manner, especially as a form-locking connection.

For a particularly safe transport of the removed rod magazine it is of advantage that a safety cover is provided, which can be placed onto the front end of the rod magazine, more particularly the receiving part, and can be locked. As a result, the rod magazine including the magazine-stored inner tubes and outer tubes can be handled in a particularly safe way. The safety cover is preferably provided on the front end of the drum magazine that faces away from the receiving spaces.

By preference, a mounting is provided according to the invention, which can serve to guide a drill drive of the double rod. The drill drive can be a single drive for simultaneously driving both rods or it can consist of two separate drives, in which case the drive or drives can be designed both in a rotating and a rotary impact fashion. The handling of the device according to the invention is facilitated in that the axis of rotation of the revolver magazine and/or the longitudinal axes of the receiving spaces are arranged at least approximately parallel to the mounting and/or to a drilling axis extending thereon. On the revolver magazine the transfer position is preferably located at the same height as the drilling axis. In this case a translational motion is merely required during the removal of the tubes from the magazine. A particularly compact device is achieved in that the rod magazine is supported on the mounting. An especially simple construction is given in that at least one retaining arm is provided, on which the rod magazine is supported on the mounting, and in particular on the central axle tube.

It is suitable for the receiving spaces to be designed as slide-in holders that release the tubes upon an axial displacement. For example the retaining element for the inner tube can have a retaining mandrel, onto which the inner tube is slid. The retaining element for the outer tube can have e.g. a receiving sleeve and/or also a receiving mandrel. It is most favourable for the two retaining elements of a double receiving space to be provided for a coaxial retention of the outer tube and the inner tube. In particular, if the receiving spaces have sleeves for retaining the tubes they can also be referred to as vessels.

By preference, the inner tubes are supported in such a manner in the rod magazine that they slightly project from the surrounding outer tube. With a simple construction of the manipulator it is then possible to jointly remove both tubes from the magazine. If the inner tubes are of the same length or shorter than the outer tubes, provision can be made for the retaining elements for the inner tubes to be designed in an axially offset fashion with respect to the retaining elements for the outer tubes. Preferably, the retaining elements have a first stop for the inner tube and a second stop for the outer tube, with the stops being axially offset with regard to each other. The stop for the inner tube is preferably offset towards the tube to be received and/or towards the inside of the magazine.

Advantageously, the manipulator has three axes of motion, one of which extends approximately parallel to the axis of rotation of the revolver magazine, the longitudinal axis of the mounting and/or the longitudinal axes of the receiving spaces. It is suitable for the axes of motion to be preferably orthogonal linear axes, whereby particularly compact dimensions of the device according to the invention are rendered possible. Basically, the axes of motion can also be axes of rotation. An especially robust and versatile arrangement is provided in that the manipulator has a manipulator arm which is displaceable on a longitudinal guide. The longitudinal guide is suitably provided on the mounting or is part thereof. The manipulator arm is preferably telescopic, by being designed in particular in a double telescopic way in altogether two directions of movement.

A particularly speedy and safe operation of the device in accordance with the invention is rendered possible in that the manipulator has at least two gripping claws. According to the invention the gripping claws can be operated independently of each other. By preference, the gripping claws are designed with a gripping range that covers both the diameter of the inner tubes and the diameter of the outer tubes so that each gripping claw is able to grip both outer and inner tubes. The two gripping claws are preferably arranged in an axis extending parallel to the mounting and/or the drilling axis. Advantageously, the two gripping claws are connected via a yoke that is preferably provided at the end side of the manipulator. More particularly, during removal of the tubes from the rod magazine provision can be made for the inner tube and the outer tube to be gripped by separate gripping claws. When placing the tubes into the rod magazine both gripping claws can be used for the same tube.

Preferably, means are provided according to the invention, with which the rod magazine can be infinitely variably positioned and/or locked. Through this it is possible to infinitely variably position and lock the angular positions of the receiving spaces, in particular the removal and/or charging position.

The inner tubes can be designed for example in a smooth manner or as auger drilling tubes. If use is made of auger drilling tubes it is of advantage for the gripping claws to have clamp shells that are of a greater width than the dimension of an auger flight pitch. In this way a safe gripping operation can be ensured.

According to the invention the afore-described charging device is provided on a drilling apparatus with a drilling device that has a drill drive for dual tube drilling. Drilling apparatuses of such kind can be equipped in a known manner with a carriage, various component units as well as an operating unit. Through an adjusting mechanism located above the carriage the drilling device can be placed into nearly any chosen position.

In accordance with the invention the drilling apparatus is characterized in that the drill drive is supported on a mounting, in that the rod magazine is arranged between the mounting and a first telescopic arm of the manipulator and in that on the first telescopic arm a second telescopic arm with the gripping claws is supported in a displaceable manner. Hence, the manipulator and the revolver magazine can be arranged on one side of the mounting so that on the opposite side of the mounting free access is provided for an operator to the drill drive and the drill rod. The manipulator is preferably fixed below the revolver magazine on the mounting. Therefore, the approximately C-shaped manipulator embraces the revolver magazine which leads to a particularly compact arrangement.

In principle, the rod magazine according to the invention can also be equipped with a single rod instead of a double rod. The exchangeable function of the rod magazine can be regarded as an independent aspect of the invention.

In a method according to the invention it is intended that tubes arranged inside each other on a double receiving space are jointly removed from the rod magazine and placed into a drilling axis and/or that during magazine storage of the double rod first the inner tubes and then the outer tubes of the double rod are stored in the rod magazine. By preference, first the inner rod is completely stored in the magazine and subsequently storage of the outer rod is commenced.

In the following the invention will be described in greater detail by way of preferred embodiments which are shown schematically in the Figures, wherein.

Figure 1A:
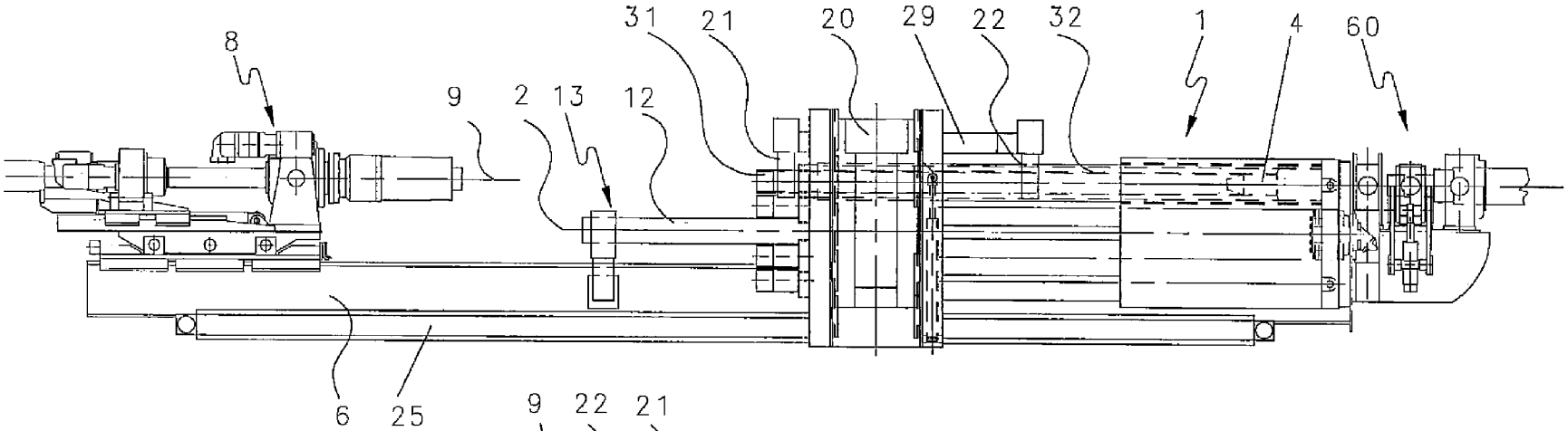
FIG. 1 shows a side view (a) and a cross-sectional view (b) of a device according to the invention for carrying out the method according to the invention pursuant to a first embodiment.
Figure 1B:
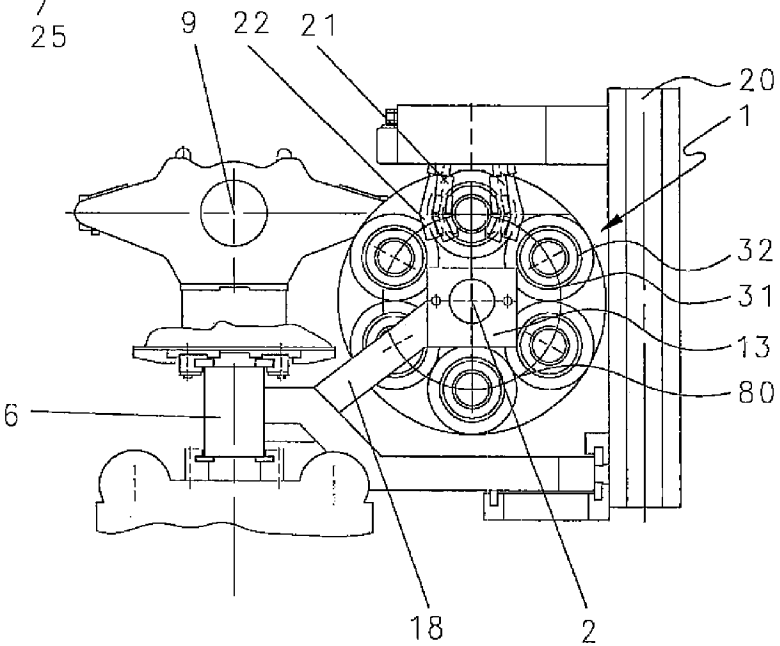

An embodiment of a device according to the invention is shown in FIG. 1. The illustrated device is part of a drilling apparatus and has a mounting 6, on which a drill drive 8 is provided in a displaceable manner for driving a double drill rod. At the bottom end of the mounting 6 several clamping claws 60 are provided for screwing and/or breaking and for retaining the drill rod.

The device has a rod magazine 1 designed as a revolver magazine. This rod magazine 1 is rotatably supported about an axis of rotation 2 relative to the mounting 6 and to the drill drive 8. In the embodiment depicted the rod magazine 1 has six receiving spaces 4, in which an outer tube 32 of the drill rod and, arranged centrally and coaxially thereto, an inner tube 31 of the drill rod can each be received. The receiving spaces 4 are arranged next to each other along the circumference of the rod magazine 1. They are located on a circle 80, whose centre lies on the axis of rotation 2 of the rod magazine 1.

To achieve a rotatable support, the rod magazine 1 has a central axle tube 12, on which the individual receiving spaces 4 are fixed in a star-shaped way. This axle tube 12 is supported in a bearing point 13 that is designed as a pivot bearing and provided on a retaining arm 18 of the mounting 6.

Figure 4:
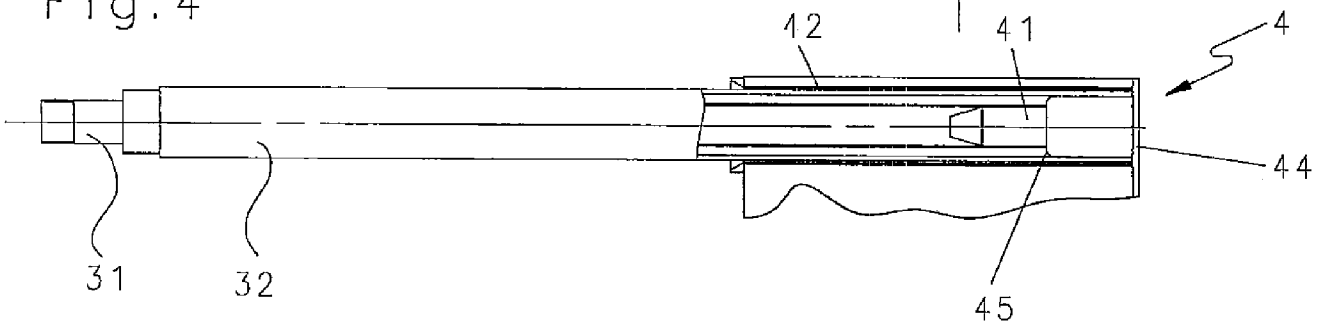
FIG. 4 shows a partially sectional detailed view of a double receiving space of the rod magazine from FIG. 1 with a smooth inner tube.

The receiving spaces 4 formed as double receiving spaces are shown in greater detail in FIG. 4. As can be seen in FIG. 4, the receiving spaces 4 each have a retaining sleeve 42, through which a retaining element is formed for the outer tube 32. This retaining sleeve 42 can be designed for example in a bushing. In the retaining sleeve 42 a retaining mandrel 41 is arranged that projects from the bottom 44 of the retaining sleeve 42. The retaining mandrel 41 forms a retaining element for the inner tube 31. Retaining mandrel 41 and retaining sleeve 42 are arranged coaxially. The retaining mandrel 41 has an annular stop 45 which is offset with respect to the bottom 44 of the retaining sleeve 42 in the direction of the tube 31 to be received, i.e. towards the tip of the mandrel and the opening of the sleeve. Therefore, the inner tube 31 is retained in an offset fashion with respect to the outer tube 32 whilst projecting from the latter on the side that faces away from receiving space 4.

Figure 3:
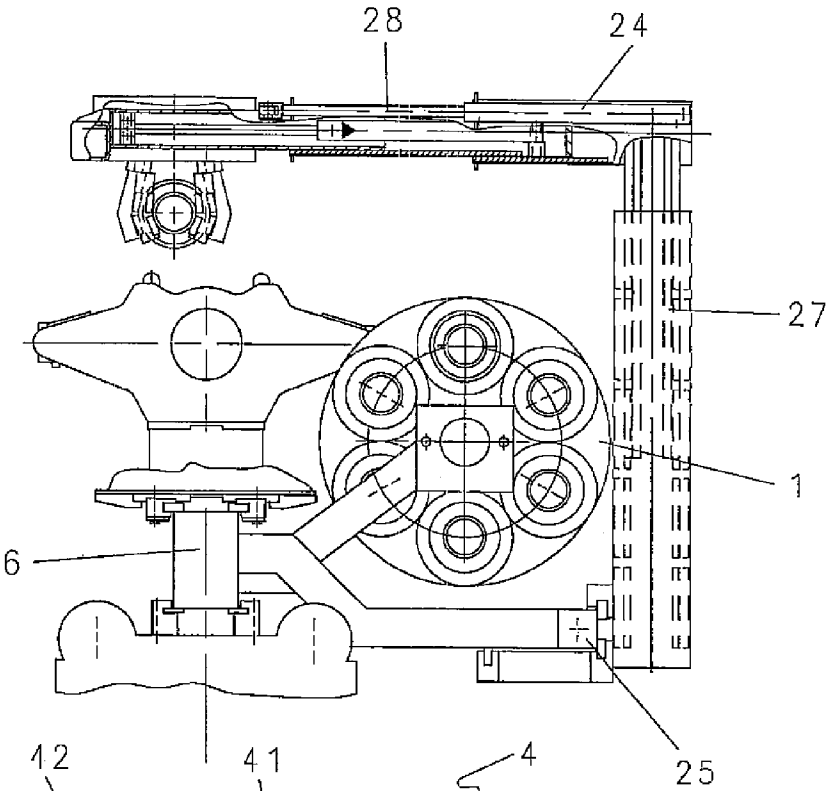
FIG. 3 shows a cross-sectional view of the device from FIG. 1 with the manipulator shown partially sectioned in a different operational condition of the manipulator.
Figure 2:
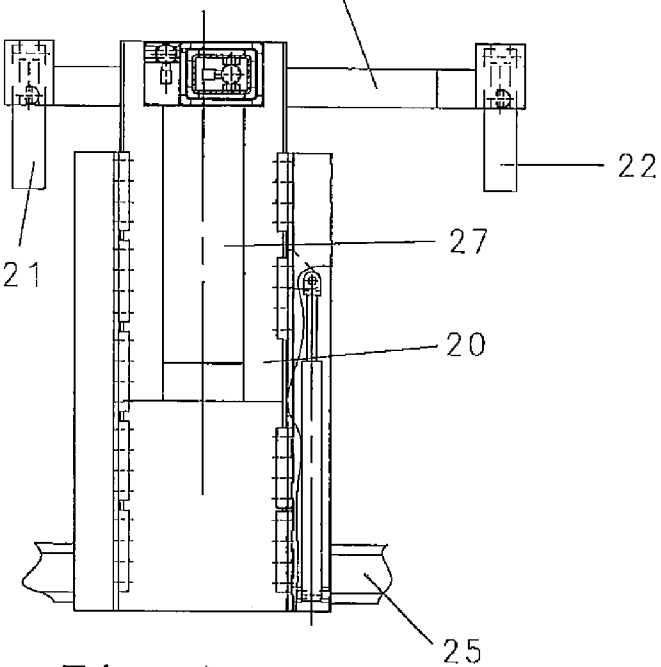
FIG. 2 shows a partially sectional detailed view of the manipulator from FIG. 1 depicted from the side.

As can be seen in FIG. 1, a manipulator 20 is provided for movement of the tubes 31, 32 between the rod magazine 1 and the drilling axis 9 that extends longitudinally of the mounting 6. The manipulator 20 is designed as a triple-axis manipulator having three orthogonal linear axes of motion. As can be taken from FIG. 1 and in a more detailed fashion also from FIGS. 2 and 3, the manipulator 20 has a manipulator arm 24 which can be moved in the longitudinal direction of the mounting 6 and parallel to the drilling axis 9. To this end on the mounting 6 a rail 25 is provided via retaining arms, on which the manipulator arm 24 is supported in a sliding manner by means of a longitudinal guide, in particular a slide guide. For the driven displacement a driving device—not depicted here—is provided.

The manipulator 20 has two telescopic arms 27, 28. The telescopic arm 27 can be telescopically extended transversely to the longitudinal direction of the mounting 6, while the second telescopic arm 28 can be telescopically extended in the direction located perpendicularly to the two directions mentioned before. The L-shaped telescopic arms 27, 28 are arranged such that they embrace the rod magazine 1. In particular, the second telescopic arm 28 extends from the first telescopic arm 27 across the rod magazine 1. For the driven telescopic extension the two telescopic arms 27, 28 each have at least one hydraulic cylinder.

At the end side of the second telescopic arm 28 a yoke 29 is provided that extends parallel to the drilling axis 9 and to the longitudinal direction of the mounting 6. At both opposite ends of the yoke 29 a gripping claw 21, 22 is each provided for gripping the tubes 31, 32.

In FIGS. 1 and 6 to 8 single method steps are shown during the joining of the magazine-stored drilling rod. As depicted in these Figures, during downward drilling the inner tube 31 and the outer tube 32 are jointly placed, i.e. in pairs, into the drilling axis 9.

As shown in FIG. 1, at the beginning of the removal process the gripping claws 21, 22 are displaced through a movement of the manipulator 20 towards the tube pair to be removed and the gripping claws 21, 22 are closed. In doing so the first gripping claw 21 grips an inner tube 31 while the second gripping claw 22 grips a surrounding outer tube 32. Afterwards (FIG. 6) the manipulator 20 is moved along the mounting 6 from the mounting base towards the drill drive 8, whereby the tube pair consisting of outer tube 32 and inner tube 31 is pulled out of the receiving space 4. Through an extension of the first telescopic arm 27 the tube pair is then lifted radially out of the rod magazine 1.

Figure 7:
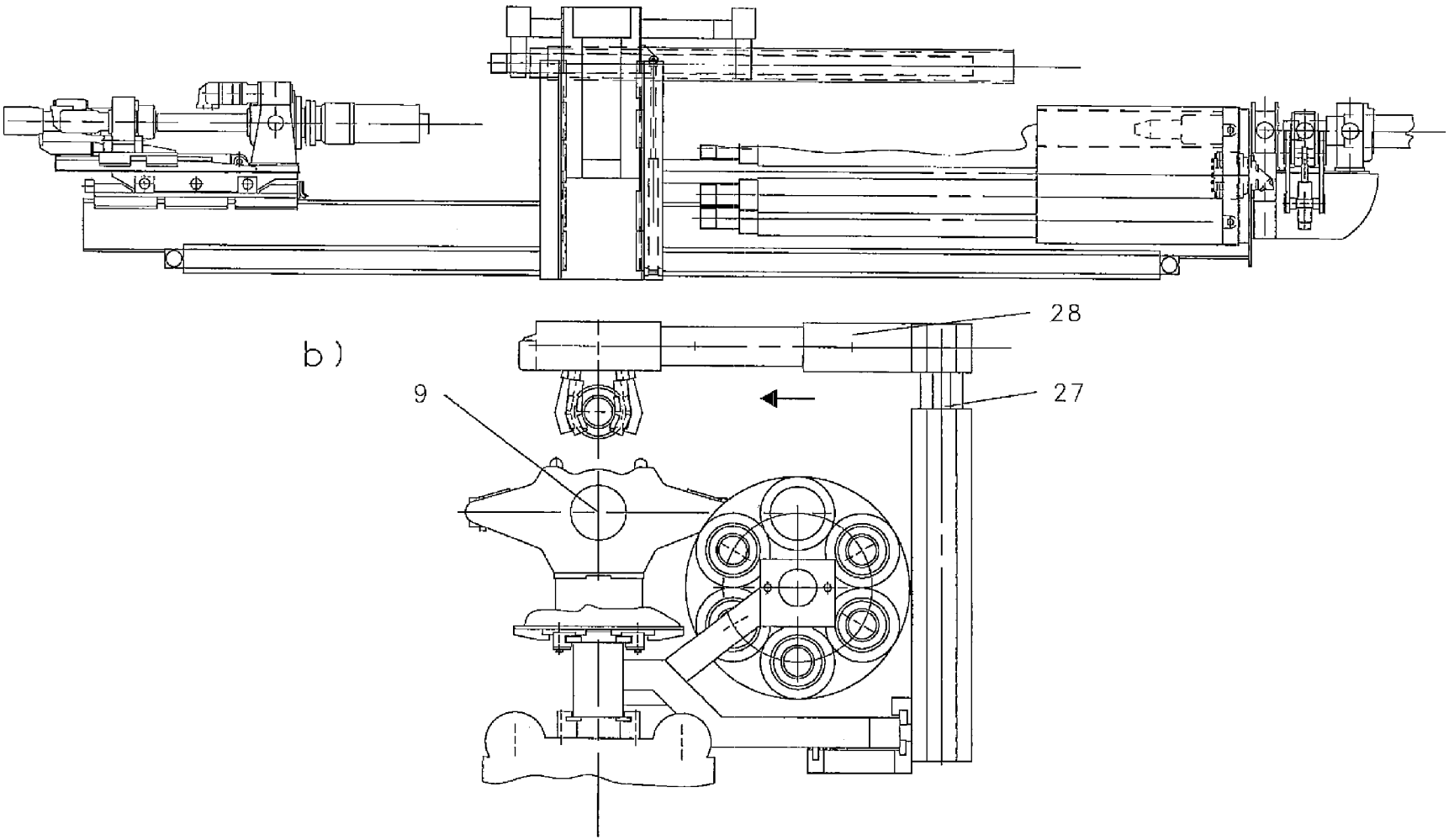

According to FIG. 7 the second telescopic arm 28 is extended and the retained tube pair is arranged above the drilling axis 9. Afterwards the manipulator 20 is moved together with the gripped tube pair along the mounting 6 from the drill drive 8 towards the base of the mounting.

Figure 8:
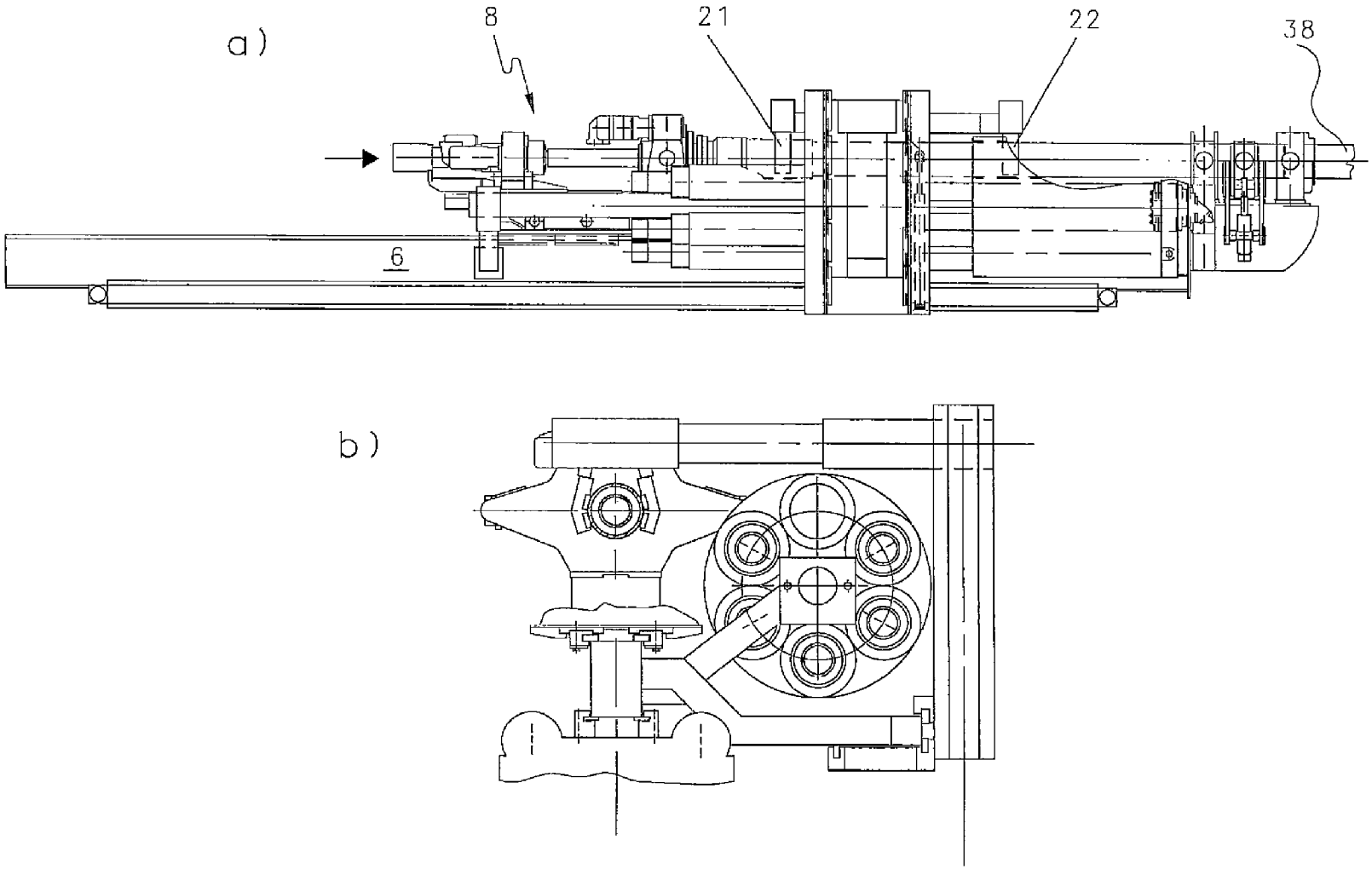

At this point the first telescopic arm 27 is retracted again, upon which the tube pair is lowered into the drilling axis 9. As illustrated in FIG. 8, the drill drive 8 is subsequently moved along the mounting 6 towards the tube pair. First the inner tube 31 is connected to the drill drive 8 and then the first gripping claw 21 is opened. Next the outer tube 32 is connected to the drill drive 8 and the second gripping claw 22 is opened. The tube pair is now ready to be connected with an adjacent tube pair 38 that is already sunk.

To add a further tube pair the rod magazine 1 is turned on in such a way that a filled receiving space 4 reaches the upper removal position so that the described removal process is recommenced.

The recovering of the rod and the magazine storage thereof are explained in FIGS. 9 to 12.

Figure 9:
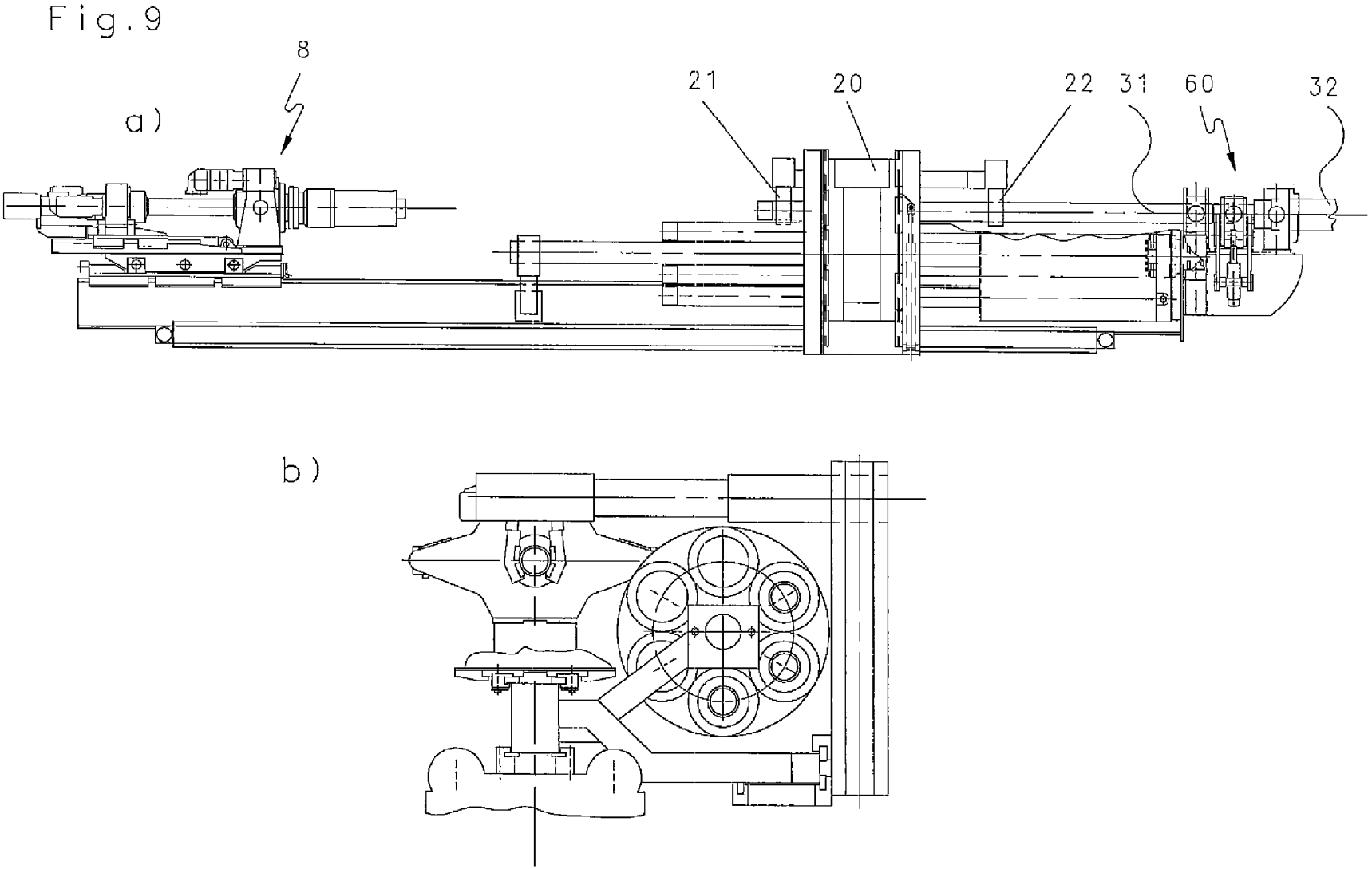
FIGS. 9 to 12 show the device from FIG. 1 during the magazine-storage of the drill rod in conformity with the method according to the invention in side view (a) and cross-sectional view (b)

First an inner tube 31 is pulled out axially from the surrounding outer tube 32 by means of the drill drive 8, detached from the remaining inner tube rod and gripped by both gripping claws 21, 22 of the manipulator 20 (FIG. 9). If required, the outer tube 32 can be retained by means of the clamping claws 60.

By subsequently operating the manipulator 20 in all three axial directions the inner tube 31 is arranged before the front end of an empty receiving space 4 of the rod magazine 1.

On consequent movement of the manipulator 20 in the longitudinal direction of the mounting 6 towards the mounting base, the inner tube 31 is inserted into the receiving space 4. Both gripping claws 21, 22 can now be opened.

Afterwards the drill drive 8 is moved towards the next inner tube 31, which is then pulled out of the surrounding outer tube 32 through a retraction of the drill drive 8. By repeating the described steps the entire inner rod can be pulled out of the outer rod and stored in the magazine. The inner rod section that remains in the drilling axis 9 after each removal step is retained by means of the clamping claws 60.

Once the inner rod is pulled out completely, the drill drive 8 is connected with the outer rod and an outer tube 32 is pulled through an axial movement of the drill drive 8 and detached from the adjacent outer tube.

Figure 10:
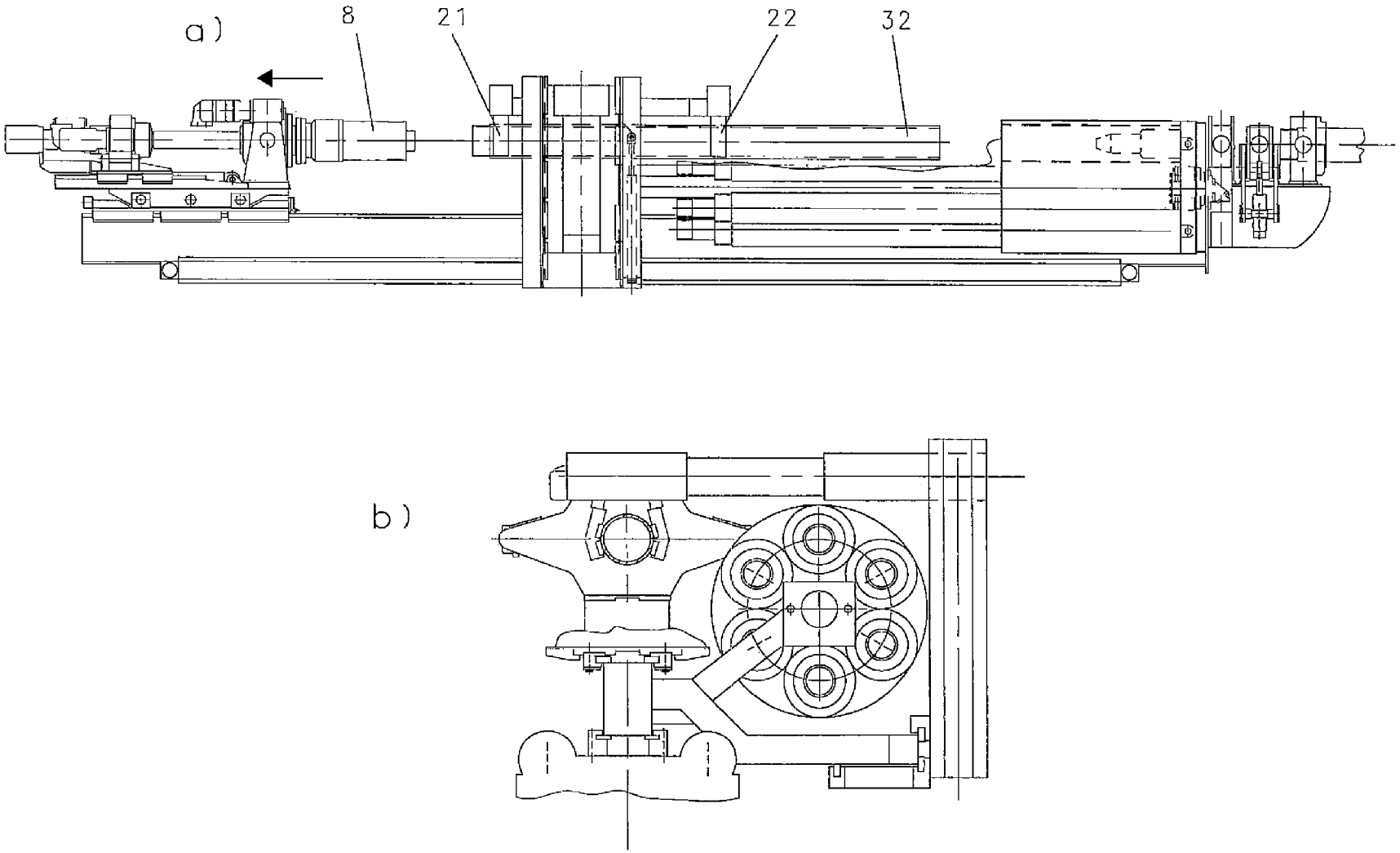
Figure 11:
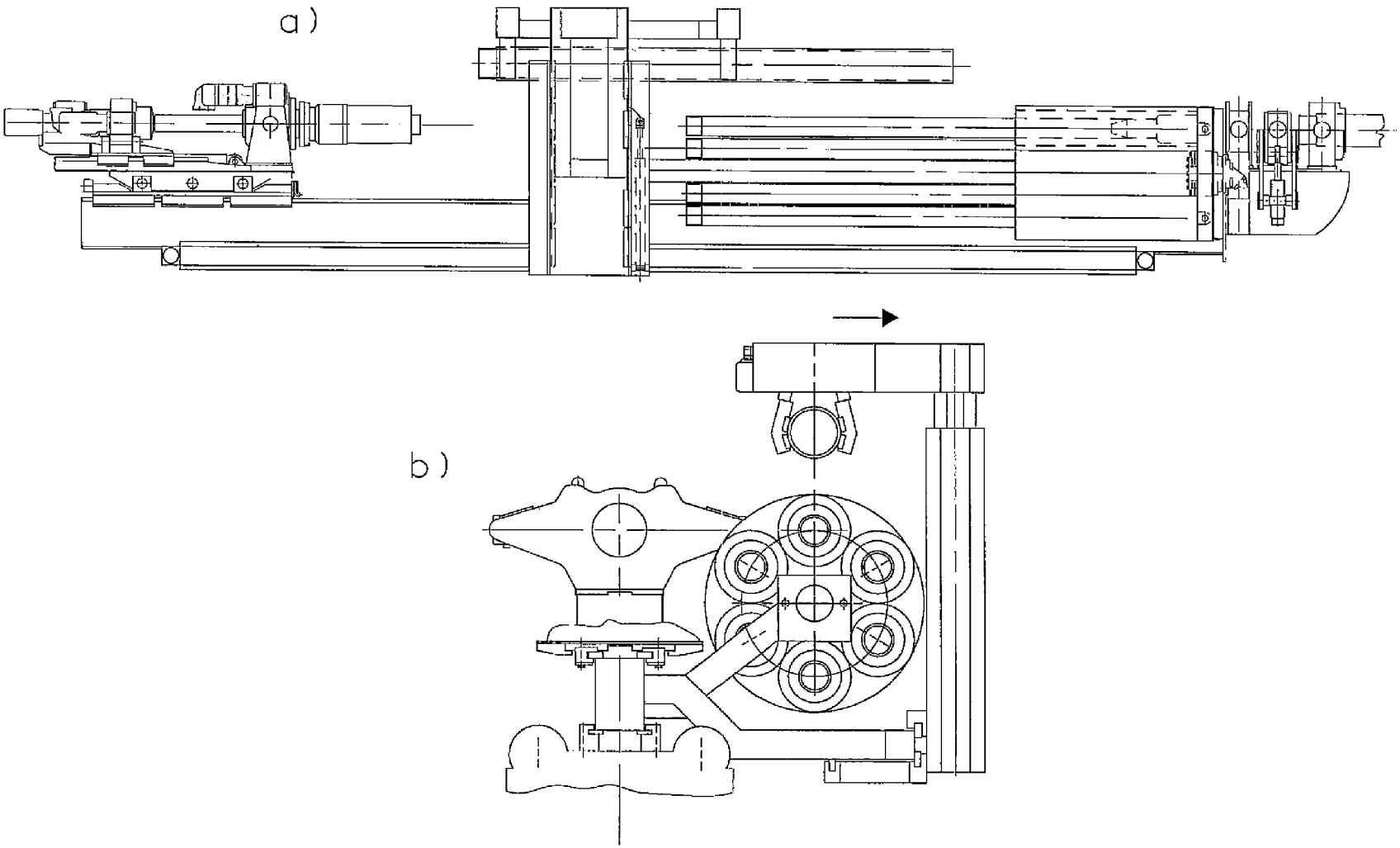
Figure 12:
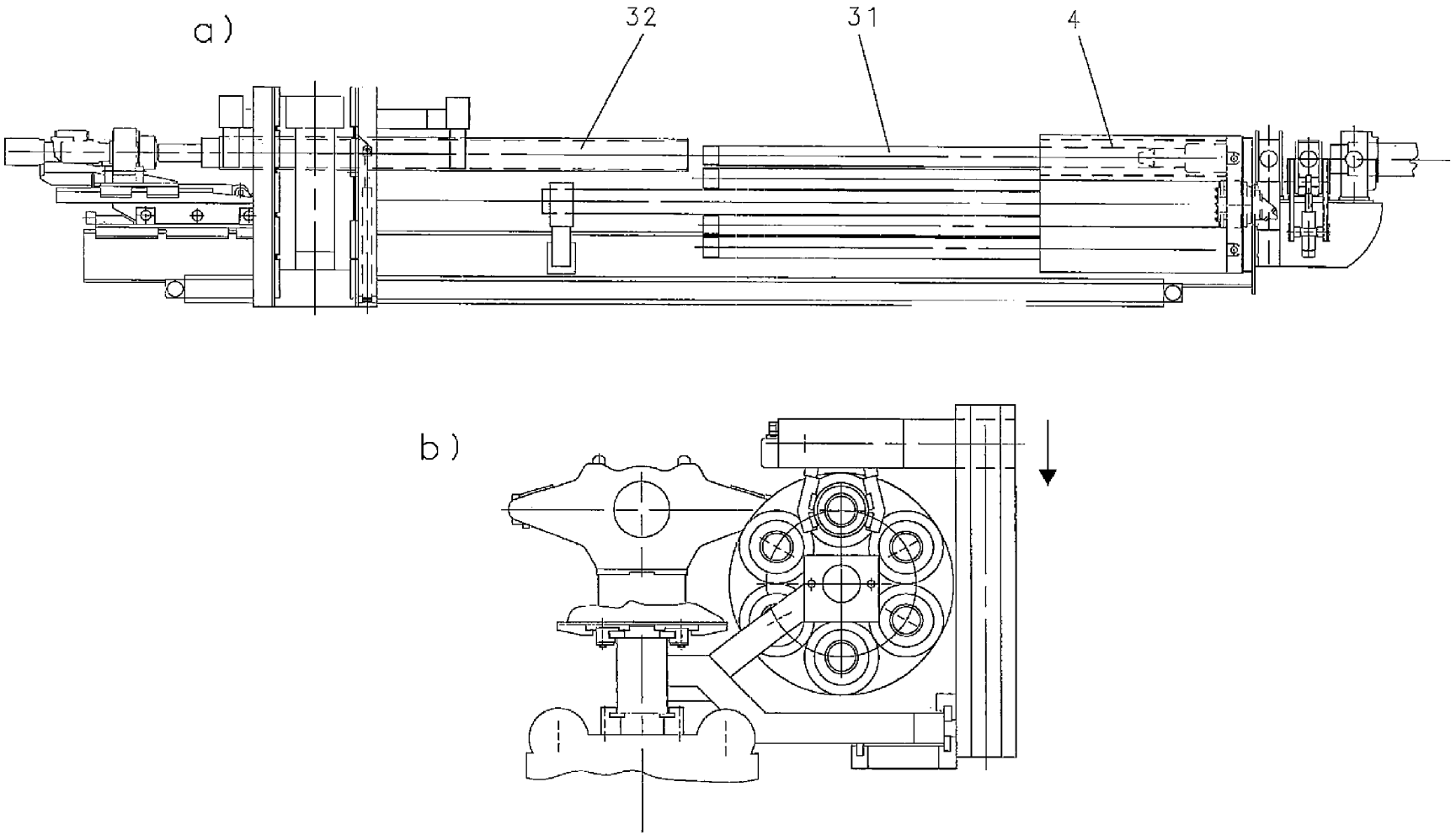

According to FIG. 10 the outer tube 32 is gripped by both gripping claws 21, 22 of the manipulator 20 and separated from the drill drive 8. In accordance with FIGS. 11 and 12 the manipulator 20 is moved in such a manner that the outer tube 32 is arranged at the front end of a receiving space 4 that is already occupied by an inner tube 31.

Through a final displacement of the manipulator 20 along the mounting 6 the outer tube 32 is moved over the inner tube 31 into the receiving space 4. The two gripping claws 21, 22 that retain the outer tube 32 can now be opened. For pulling a further outer tube 32 the process can then be repeated until the entire outer rod 32 is stored in the magazine.

Figure 5:
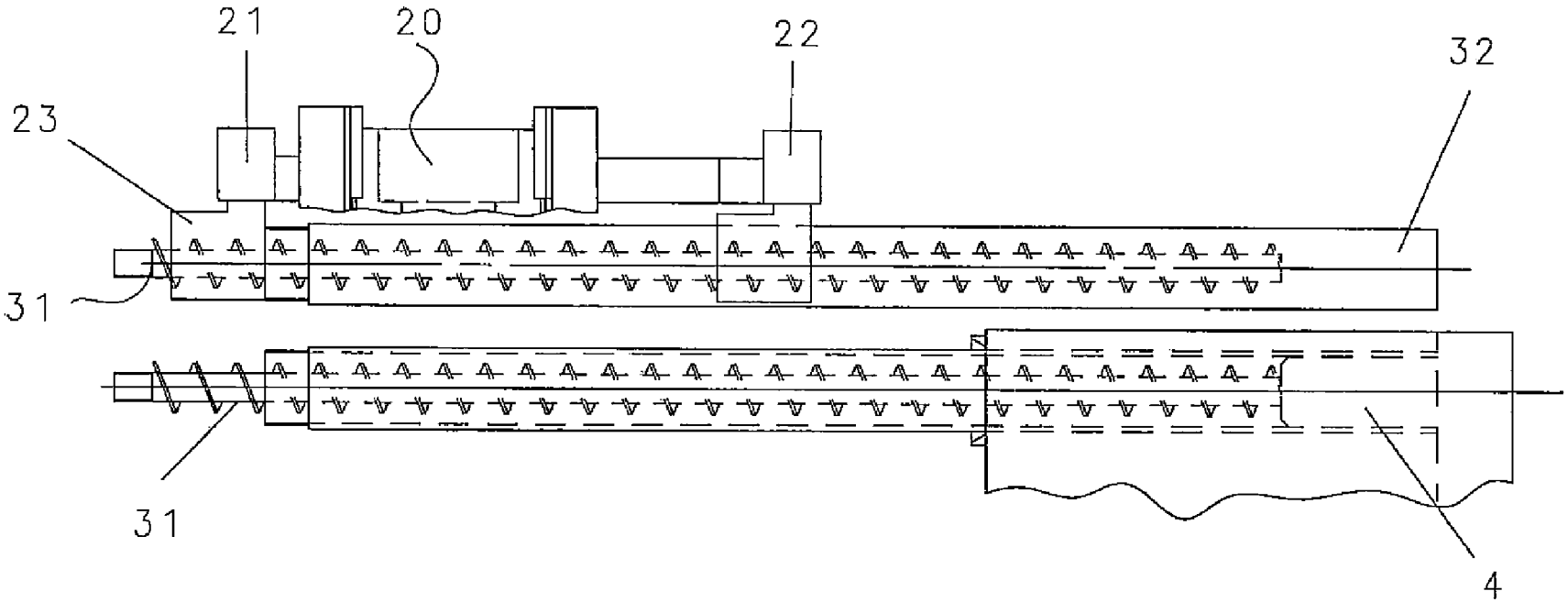
FIG. 5 shows a partially sectional detailed view of a double receiving space of the rod magazine from FIG. 1 with a flight-bearing inner tube.
Figure 6:
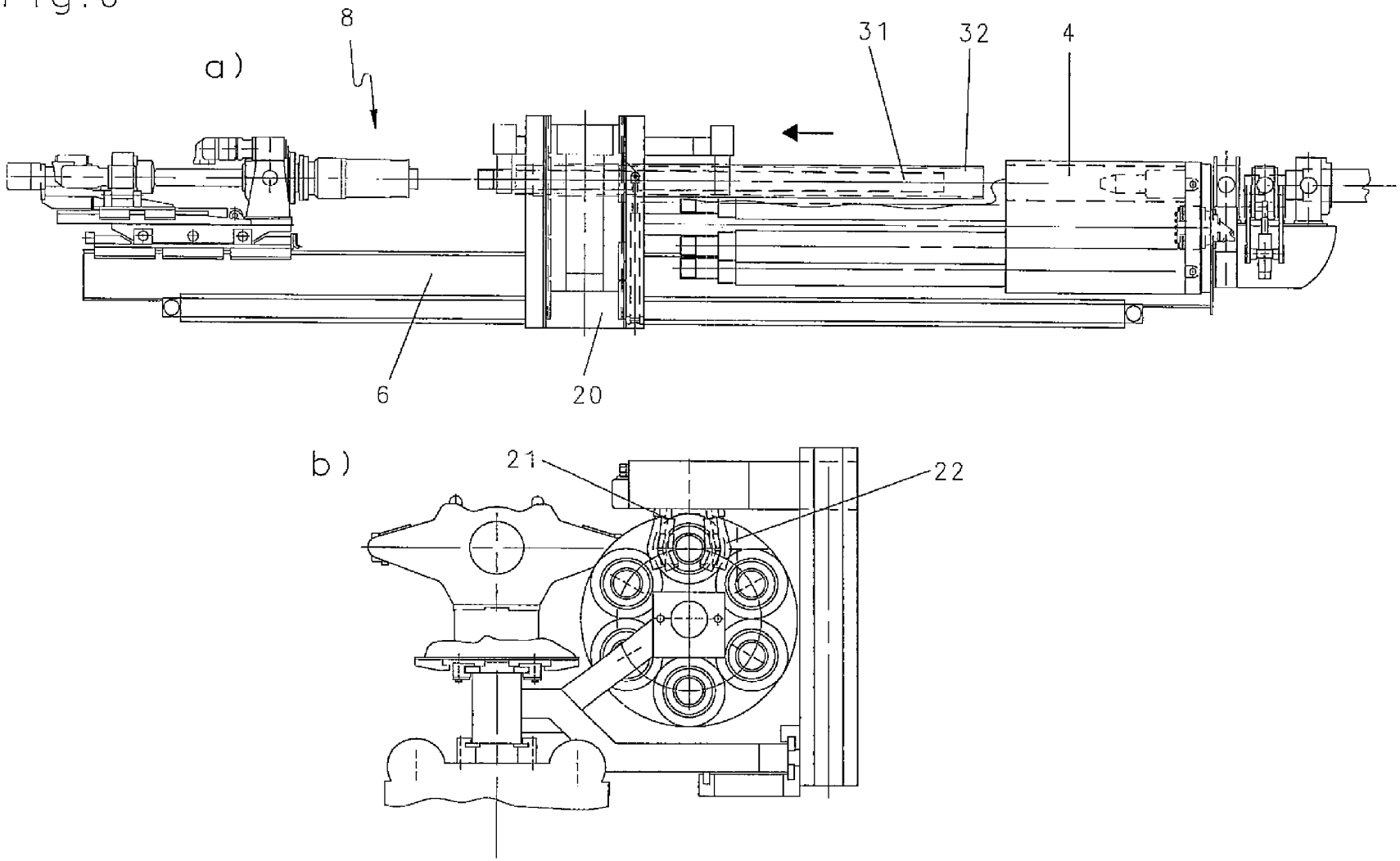
FIGS. 6 to 8 show the device from FIG. 1 during the joining of a magazine-stored drill rod in the drilling axis in conformity with the method according to the invention in side view (a) and cross-sectional view (b)

As depicted in FIG. 5, the inner tube 31 can also have an auger flight. In this case it is suitable for the clamp shells 23 of both gripping claws 21, 22 to have a width that is larger than the pitch of the auger flight.

Figure 13:
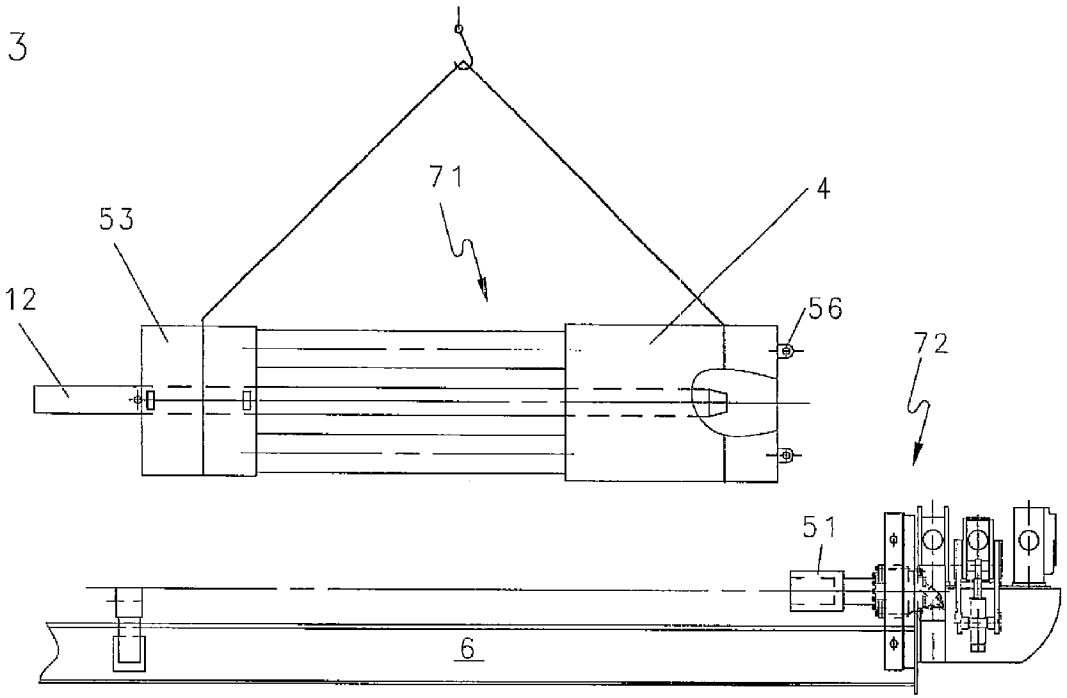
FIG. 13 shows the device from FIG. 1 with the magazine storage folded open.
Figure 14:
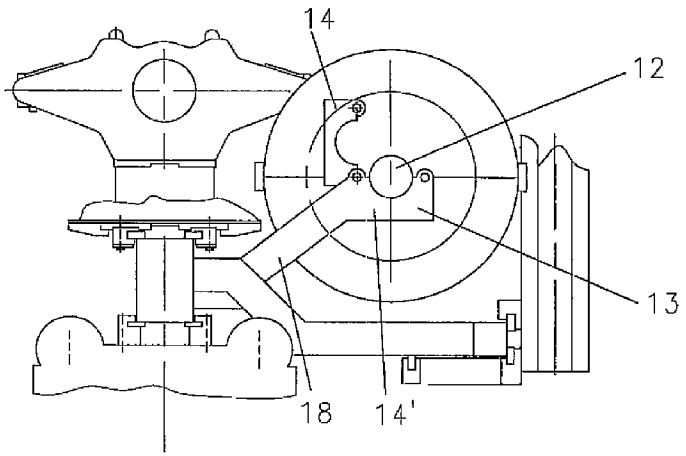
FIG. 14 shows the device from FIG. 1 with the magazine divided into parts.

FIGS. 13 and 14 illustrate the way in which the rod magazine 1 of the device of FIG. 1 can be provided in an exchangeable manner.

In such case the bearing point 13, on which the axle tube 12 of the rod magazine 1 is rotatably supported is designed in a detachable fashion. In particular, the bearing point 13 has two bearing shells 14, 14', with the first bearing shell 14 being pivotable with respect to the second bearing shell 14'. As a result, the bearing can be opened and the axle tube 12 can be removed.

As can be taken from FIG. 13, a plug connection with a sleeve 51 is provided at the rear of the axle tube 12. From this sleeve 51 the axle tube 12 can be pulled out axially towards the front after having been detached the axle tube 12 by releasing the front bearing point 13. In doing so a front part of the rod magazine 1 that contains the receiving spaces 4 and can therefore also be referred to as receiving part 71 can be detached from a rear drive part 72 of the rod magazine 1. To ensure safe transport of the pulled out receiving part 71 together with the tubes disposed inside, a cover 53 is provided on the rod magazine 1 at the front end facing away from the receiving spaces 4, which delimits an axial movement of the tubes and, in particular, prevents a dislodgement from the receiving spaces 4.

In the drive part 72 that remains on the mounting 6 after removal of the receiving part 71 the rotary drive of the rod magazine 1 is located. To transmit the driving power from the drive part 72 to the receiving part 71 the sleeve 51 can be designed for a form-locking connection with the axle tube 12.

On the receiving part 71 eyes 56 are provided, through which the former can be bolted on the drive part 72 to be secured against unintended detachment and/or for the torque transmission.

The invention claimed is:

1. Drilling apparatus, comprising a drilling device, which has a drill drive for double-tube drilling, the drill drive being supported on a mounting, and a device for charging the drilling device with a double rod, the device for charging the drilling device comprising:

a rod magazine having several receiving spaces for inner tubes and outer tubes of the double rod, and a manipulator for gripping and moving the tubes into and out of the rod magazine, wherein the rod magazine is designed as a rotatable revolver magazine comprising double receiving spaces, which each have a first retaining element for an outer tube and a second retaining element for an inner tube arranged inside the outer tube, wherein the inner tube is supported by the second retaining element coaxially with the outer tube, the rod magazine is arranged between the mounting, a first telescopic arm of the manipulator, and a second telescopic arm of the manipulator, and wherein the second telescopic arm is located orthogonally and in a displaceable manner on the first telescopic arm, the second telescopic arm including gripping claws.

2. Device according to claim 1, wherein the receiving spaces are arranged on a circle, whose centre lies on an axis of rotation of the rod magazine.

3. Device according to claim 1, wherein the rod magazine has a central axle tube, through which the rod magazine is supported on at least one bearing point.

4. Device according to claim 1, wherein at least one bearing point of the rod magazine is detachable.

5. Device according to claim 1, wherein the rod magazine is designed of several parts comprising a receiving part, on which the receiving spaces are arranged, and a drive part, on which a rotary magazine drive is arranged, the receiving part being provided in a detachable manner on the drive part.

6. Device according to claim 1, wherein the retaining elements have a first stop for the inner tube and a second stop for the outer tube, the stops being offset axially with respect to each other.

7. Device according to claim 1, wherein the manipulator has three axes of motion, one of which extends approximately parallel to the longitudinal axis of the receiving spaces.

8. Device according to claim 1, wherein the manipulator has two gripping claws.

9. The drilling apparatus of claim 1, wherein the first telescopic arm and the second telescopic arm embrace the rod magazine.

10. The drilling apparatus of claim 9, wherein the second telescopic arm extends from the first telescopic arm across an axis of rotation of the rod magazine.

11. Drilling apparatus, comprising a drilling device, which has a drill drive for double-tube drilling, the drill drive being supported on a mounting, and a device for charging the drilling device with a double rod, the device for charging the drilling device comprising:

a rod magazine having several receiving spaces for inner tubes and outer tubes of the double rod, and a manipulator for gripping and moving the tubes into and out of the rod magazine, wherein the rod magazine is designed as a rotatable revolver magazine comprising double receiving spaces, which each have a first retaining element for an outer tube and a second retaining element for an inner tube arranged inside the outer tube, wherein the inner tube is supported by the second retaining element coaxially with the outer tube, the rod magazine is arranged between the mounting, a first telescopic arm of the manipulator, and a second telescopic arm of the manipulator, the mounting comprising an elongated, mast-like element; and wherein the second telescopic arm is located orthogonally and in a displaceable manner on the first telescopic arm, the second telescopic arm including gripping claws.

12. The drilling apparatus of claim 11, wherein the first telescopic arm and the second telescopic arm embrace the rod magazine.

13. The drilling apparatus of claim 12, wherein the second telescopic arm extends from the first telescopic arm across an axis of rotation of the rod magazine.

* * * * *